United States Patent [19]

Peters, Jr.

[11] 4,058,226

[45] Nov. 15, 1977

[54] HIGH SPEED AUTOMATIC STACKER FOR PARTITIONS AND THE LIKE

[75] Inventor: Charles Peters, Jr., Norco, Calif.

[73] Assignee: Box Innards, Inc., Anaheim, Calif.

[21] Appl. No.: 650,247

[22] Filed: Jan. 19, 1976

[51] Int. Cl.[2] ..... B65G 57/00

[52] U.S. Cl. ..... 214/7; 198/422; 214/65; 271/192; 271/216; 271/221

[58] Field of Search ..... 214/7, 65; 271/192, 271/216, 213, 207, 220, 221; 198/416, 417, 462, 459, 422, 423, 425

[56] References Cited

U.S. PATENT DOCUMENTS

| | | | |
|---|---|---|---|
| 1,847,812 | 3/1932 | Burton et al. | 214/7 |
| 2,148,371 | 2/1939 | Galloway | 214/7 |
| 2,988,236 | 6/1961 | Shields | 214/65 |
| 3,144,740 | 8/1964 | Erickson et al. | 198/416 |
| 3,205,794 | 9/1965 | Califano et al. | 271/192 |
| 3,974,626 | 8/1976 | Getsch | 271/216 |

*Primary Examiner*—Robert J. Spar
*Assistant Examiner*—Ross Weaver
*Attorney, Agent, or Firm*—Perry E. Turner

[57] ABSTRACT

An automatic stacker is disclosed having finned rotors to be turned incrementally so respective fins are horizontal and are spaced to support thereon the edges of a flat partition. Such partitions are successively moved onto the horizontal fins and the rotors are successively incrementally turned so as to drop the partition held thereon and to receive the next succeeding partition. The partitions thus dropped fall onto a conveyor on which succeeding partitions are overlapped, and such partitions are moved in groups to an inclined plate at which the partitions are forced to incline upwardly and close together to form an inclined stack. Different arrangements are disclosed for orienting the inclined stack to the vertical and thence moving the vertical stack to a tie station, including a movable inclined plate and cylinders with pistons for successivly moving the inclined stack to the vertical and forcing it to the tie station, and including a fixed inclined plate and pushers operated by a linear actuator or chains to move the inclined stack along a plate that makes a transition from the incline to the vertical.

9 Claims, 6 Drawing Figures

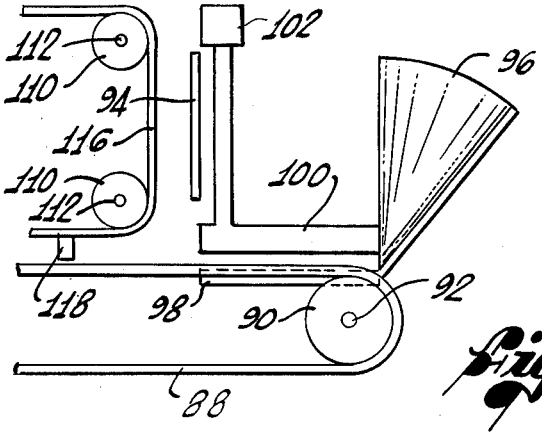
Fig. 3
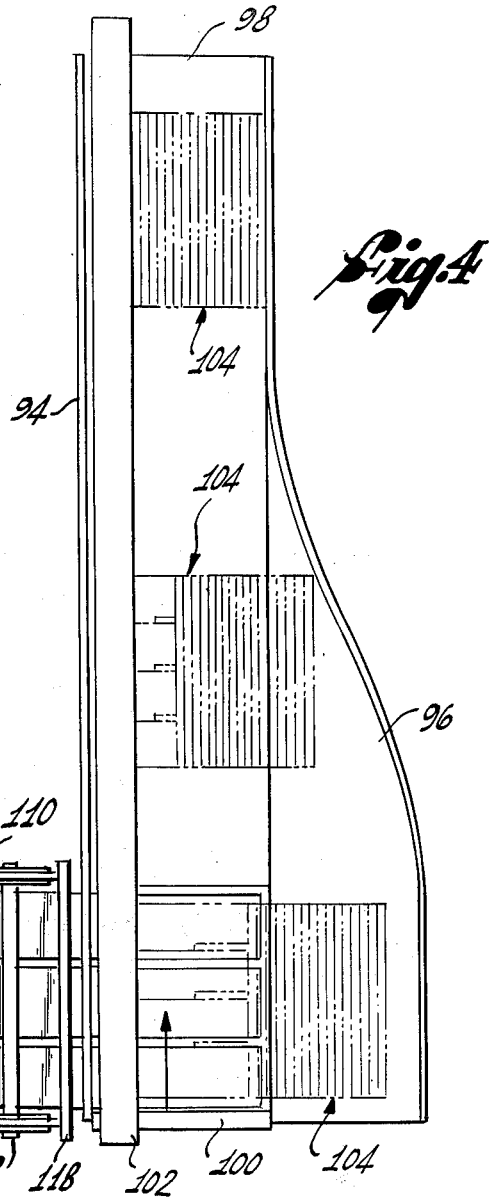
Fig. 4
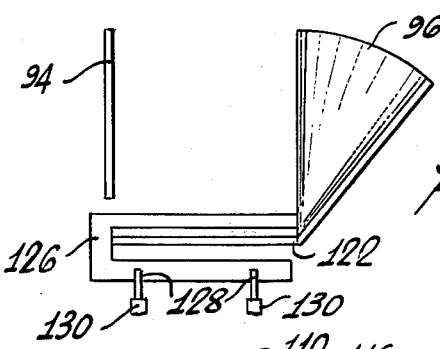
Fig. 5
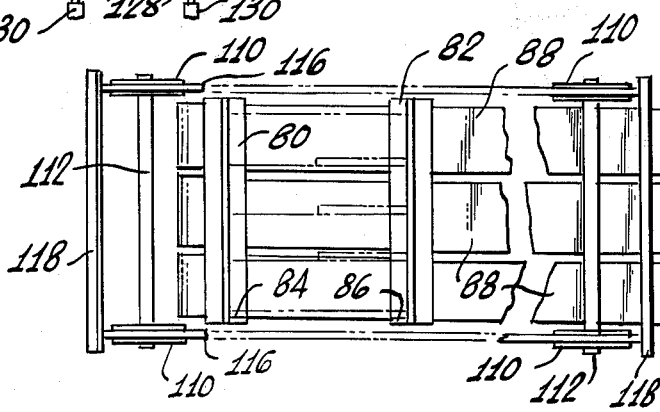
Fig. 6
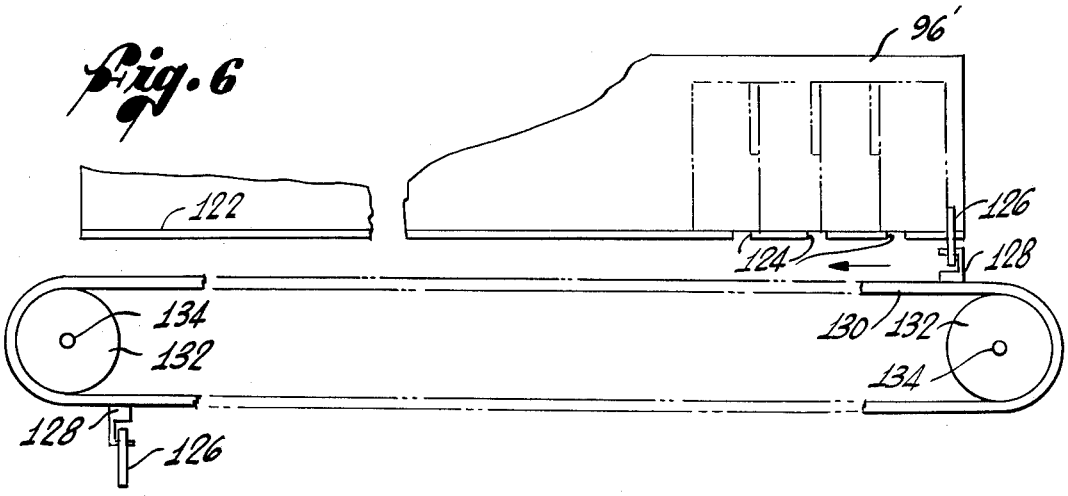

HIGH SPEED AUTOMATIC STACKER FOR PARTITIONS AND THE LIKE

BACKGROUND OF THE INVENTION

1. Field of the Invention

This invention relates to stacking mechanisms for collapsed partitions and like flat objects moving at high speeds.

2. Description of the Prior Art

In partition assemblers heretofore known, an unsolved problem has been to eliminate time consuming manual operations for stacking collapsed partitions and moving the stacks to a tie station to be tied preparatory to shipment to a customer. The fastest known way to perform these steps has been by hand, wherein a worker is stationed to intercept completed partitions, collapse them individually by manual manipulation of the strips forming the partitions, and to gather the collapsed partitions together in a stack for tying, following which he quickly moves the stack to a tie station or hands them to another worker for this purpose. Such operations, however speedy, cannot suffice to gather and stack partitions produced at high speeds as in assemblers disclosed in the copending application, "High Speed Partition Assembling Method and Apparatus," filed concurrently herewith and assigned to the same assignee as the present application.

SUMMARY OF THE INVENTION

This invention embraces stacker apparatus for collapsed container partitions or the like including conveyor means for moving them to a gathering station, means for moving the objects successivly onto the conveyor means for movement therealong in overlapped relation, inclined plate means at the gathering station against which the conveyor means causes the partitions thereon to move into close parallel relation to the inclined plate means, and means at the gathering station for moving the partitions to vertical position. Also embraced is means for moving the stack in vertical position to a tie station for tying the partitions together preparatory to shipment.

BRIEF DESCRIPTION OF THE DRAWINGS

FIG. 3 is an end view of a second embodiment of automatic stacker of the invention;

FIG. 4 is a top plan view of the stacker of FIG. 3;

FIG. 5 is an end view of a further embodiment of an automatic stacker in accordance with the invention; and FIG. 6 is a side elevation view of the stacker of FIG. 5.

DESCRIPTION OF ILLUSTRATIVE EMBODIMENTS

Figure 1:
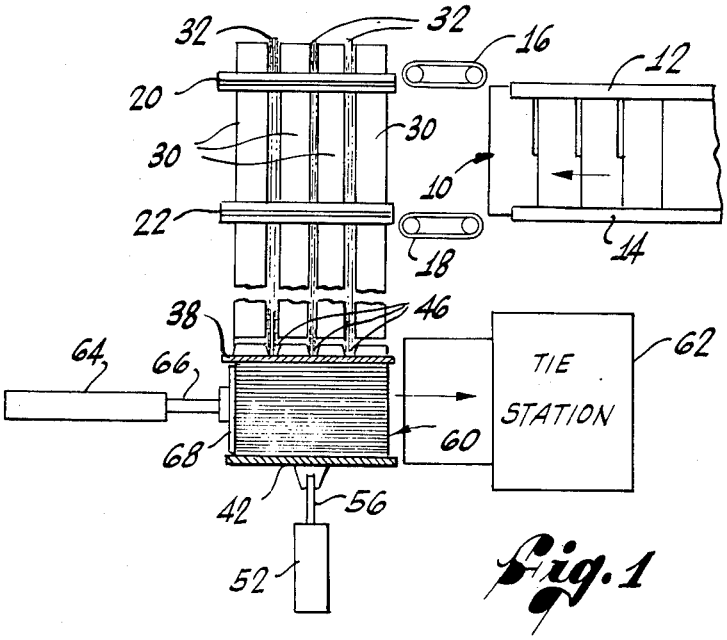
FIG. 1 is a top plan view of automatic stacker apparatus in accordance with the invention, showing a portion of a high speed assembler from which partitions are completed in collapsed condition and ejected at a high rate.

Referring to FIG. 1, a collapsed partition 10 is shown being conveyed between edge guides 12, 14 of an assembler, from which it is engaged at its opposite edges by belts 12, 18 for removal from the assembler. Such completed partitions appear at the end of the assembler at a high rate, e.g., up to four hundred per minute, and must be quickly and reliably collected, stacked and processed to a tie station in order to realize the full potential of the high speed assembler.

Figure 2:
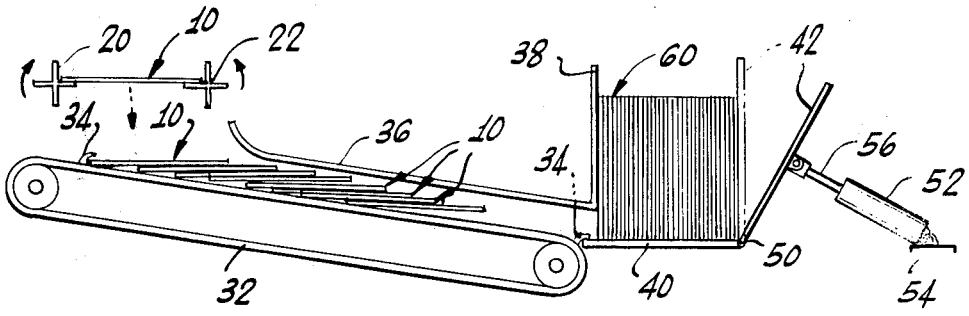
FIG. 2 is a side elevation view of the automatic stacker of FIG. 1 as viewed from the left.

To this end, a pair of elongated finned rotors 20, 22 are positioned with their axes parallel to the direction of movement of partitions by the belts, 16, 18. The rotors are operated so that the opposite edges of each partition 10 moved between the rotors come to rest on horizontal fins (FIG. 2). Preferably the rotors are subjected to incremental movement, e.g., 90°, each time a partition is received between them and located on fins thereof. The rotors are adapted for contra-rotation as indicated, and for this purpose are gear and/or belt coupled in a well known manner. Cam means (not shown) of well known design is provided between such coupling and a motor drive to effect the desired incremental movement of the rotors. Such drive operates at a speed commensurate with the appearance of completed partitions at the end of the assembler, and may be synchronized with, coupled to or constitued of the assembler drive motor. Details of such parts and devices are omitted for the sake of clarity of the drawing, it being understood that such couplings, motor drives and cam means are well known to persons skilled in the art.

Upon each quarter turn of the rotors 20, 22, the partition supported between them is dropped vertically. As will be observed, the downward movement is facilitated by the next succeeding fins, which engage the upper surface of the released partition and subject it to a downwardly directed blow. The first partition of a group lands on conveyor means shown as a number of spaced belts 30 with chains 32 located between the pairs of belts 30 as indicated. The next succeeding partitions land on the preceding ones in overlapped relation determined by the speed of the conveyor means, which may be inclined at a desired angle or made to move horizontally.

The last of a predetermined number of partitions thus dropped is engaged by pushers or fingers 34 carried by the chains 32. The conveyor is of course operated in conjunction with the rotors to insure the appearance of fingers 34 for engaging a partition after each predetermined number of incremental rotary movements of the rotors.

As the partitions move along the conveyor in the illustrated arrangement, they pass beneath a plate 36 that terminates in a vertical plate portion 38, and beyond such vertical plate 38 onto a horizontal plate 40 that is located adjacent the forward end of the conveyor. A plate 42 extends upwardly at an obtuse angle from the horizontal plate 40. Accordingly, as the partitions move over the horizontal plate 40, the first one engages and rides up the inclined plate 42, thereby causing the following partitions to follow. When the fingers 34 reach the horizontal plate 40, the partitions of the group pushed by such fingers are resting on the horizontal plate and are closely gathered into an inclined stack. In practice, the length of the conveyor is such that the number of partitions pushed by the fingers 34 is sufficient to be closely packed across the width of the horizontal plate 40.

When the fingers 34 reach the horizontal plate, they move to the underside of the conveyor for return to engage the last of another group of partitions. To permit such movement, the plate 40 has notches 46 (see FIG. 1) through which the fingers pass after the last partition of a group is moved onto the plate 40.

Upon the last of a group of partitions being moved onto the horizontal plate, and thereby stacked at an angle, they are moved off such plate for tying, after being moved to the vertical while on such plate. To accomplish such movements in the embodiment of FIGS. 1 and 2, the plate 42 is adapted for movement to a vertical position so as to right the stack. For this purpose, the plate is pivotally mounted at 50. A cylinder 52 supported at 54 has its piston rod 56 connected to the plate 42. Coincidentally with the fingers 34 reaching the horizontal plate, the cylinder 52 is actuated to cause its piston rod 56 to force the plate 52 to the vertical and thereby right the stack and form a vertical stack 60 contained between the parallel vertical plates 38, 42. Operation of the cylinder 52 is triggered by any suitable means, as via a control circuit incorporating a switch (not shown) actuated by one of the fingers 34 at the horizontal plate.

The vertical stack 60 thus formed is moved off the horizontal plate 40 to a tie station 62 which has conventional tying apparatus. Such movement is effected in the illustrated embodiment via a cylinder 64 which has a piston rod 66 connected to a plate 68 that spans the distance between the confronting faces of the vertical plates 38, 42 and is adapted to engage the stack 60. The cylinder 64 is operated upon the plate 42 reaching the vertical, to move the stack off the horizontal plate and directly to the tie station 62 for the tying operation.

Built-in delay means permits the foregoing operations to be completed before the leading edge of the first of the next succeeding group of partitions reaches the horizontal plate 40. Such delay means includes a clutch (not shown) coupling the motor drive and the driven (forward) shaft of the conveyor means. A clutch control circuit, in the case of an electromagnetic clutch, has a switch operable from the plate 42 to disengage the clutch upon the plate 42 reaching the vertical, and to permit reengagement of the clutch upon the retraction of the piston 66 and return of the plate 42 toward its inclined position. Alternatively, the clutch may be a mechanical clutch operable to disengage for a predetermined interval after each predetermined number of revolutions of the rotors 20, 22 or the conveyor driven shaft, and may be operable directly from the assembler drive motor.

FIGS. 3 and 4 illustrate a second embodiment of automatic stacker in accordance with the invention. In this embodiment rotors 80, 82 (FIG. 4) correspond to the rotors previously described, the rotors 80, 82 being shown with ribs 84, 86 against which partitions stop when ejected from the assembler and between the rotors to come to rest on horizontal fins thereof. Conveyor belts 88 onto which partitions are dropped have their supporting forward wheels or sprockets 90 carried on a shaft 92 positioned beyond the fixed vertical plate 94 and adjacent the lower edge of the inclined portion of a plate 96. The plate 96 is stationary and has its lower edge parallel to the vertical plate 94. The plate 96 has a vertical portion spaced from the inclined portion thereof, and an intermediate portion forming a transition from the incline to the vertical.

Partitions dropped onto the belts are conveyed thereon to form a stack riding on the belts as indicated at 104 against the inclined portion of the plate 96 and adjacent one end of a horizontal plate 98. An L-shaped pusher bar 100 is seen having one leg carried by a linear actuator 102 and its other leg spanning the distance between the vertical plate 94 and the opposite edge of the horizontal plate 98. The pusher bar 100 is normally positioned adjacent the end of the inclined portion of the plate 96, and is thus in a position to engage the ends of the partitions grouped together on the belts 88 and forming the stack 104 against the inclined portion of the plate 96. Operation of the linear actuator 102 causes the pusher bar 100 to engage such a group of partitions and move it to the opposite end of the horizontal plate 98, during which travel the stack 104 is effectively cammed by the transitional portion of the plate 96 towards the vertical, which position is reached and maintained via the vertical portion of the plate 96 and the fixed vertical plate 94. The tie machine (not shown) is adapted to receive the vertical stack 104 at the end of the horizontal plate 98 and tie the stack as desired.

In this latter regard, the linear actuator 102 may be operable as needed to accommodate the tie machine for effecting one or more ties around the stack. In one mode, the linear actuator stops the stack at one location to permit a single tie to be made. In another mode, where spaced ties are to be made, the linear actuator moves the stack to one location where a first tie is made around the portion aligned with the tie mechanism, and then moves the stack another few inches where it remains while a second tie is made around the second portion aligned with the tie mechanism. Following the movement of such stack by the linear actuator, such actuator reverses to return the pusher bar 100 to its starting position.

Each group of partitions to be moved along the conveyor belts 88 is gathered at the inclined portion of the plate 96 by the aid of a pusher apparatus wherein vertically spaced pairs of belt or chain support wheels or sprockets 110 are supported on shafts 112 and the wheels or sprockets on each shaft are spaced apart a distance greater than the span of the conveyor belts 88. Belts or chains 116 are threaded around the wheels or sprockets on the respective sides of the conveyor belt span, and spaced pusher bars 118 are carried at their ends by the spaced belts or chains.

Thus arranged, the pusher bars 118 move in a path over the finned rotors 80, 82 (from right to left in FIGS. 3 and 4) and around and down to pass along the upper surfaces of the conveyor belts 88 towards the inclined portion of the plate 96. As the pusher bar 118 reaches the belts 88, it engages the trailing edge of the partition dropped onto the belts and pushes the group of partitions ahead of it towards such plate 96. As such pusher bar nears the vertical plate 94 it is carried up away from the belts 88. However, the group of partitions at this point is well gathered forwardly on the portions of the belts that extend between the vertical plate 94 and the inclined portion of the plate 96. Also, the continuous left to right movement of the upper portions of the belts 88 causes the last partition of such group to be carried under the vertical plate 94 and to assume the inclined position of the preceding partitions of the group. To facilitate such gathering and retaining the gathered partitions in position until engaged by the pusher bar 100 and moved off the belts 88 and onto the horizontal plate 98, the surfaces of the belts 88 are formed of suitably textured material to prevent the partitions thereon from slipping back from the inclined position.

The distance between the pusher bars 118 associated with the conveyor belts 88 is sufficiently great to insure that the number of partitions of a group pushed by one such bar will span the space between the vertical plate 94 and the vertical portion of the plate 96. Also, suitable cam and/or clutch means are employed to establish delays essential to permit all operations for one group of partitions to be completed and parts repositioned before the first partition of the succeeding group passes under the vertical plate 94, as in the manner explained for the embodiment of FIGS. 1 and 2.

FIGS. 5 and 6 illustrate an embodiment of the invention wherein a plate 96' is an elongated plate having inclined and vertical portions connected by an intermediate transition portion, as plate 96 of FIGS. 3 and 4. The horizontal plate 122 in this embodiment is of a length equal to the plate 96'. The horizontal plate 122 has notches 124 for pusher fingers of conveyor means (not shown) of the type disclosed for the embodiment of FIGS. 1 and 2 for moving partitions in groups to form an inclined stack.

Movement of a stack of partitions along the plate 122 from inclined position to vertical position is effected by one of spaced pusher bars 126, each engaged by spaced fingers 128 carried by respective belts or chains 130 carried on wheels or sprockets 132 mounted on shafts below the plate 122 and spaced apart a distance greater than the length of the plate 122. As shown, the pusher bars 126 are U-shaped, the distance between the legs of such bar being substantially greater than the thickness of the horizontal plate 122. The upper leg of the pusher bar is adapted to move over and along the horizontal plate, with the pusher bar extending around the edge of the horizontal plate nearest the vertical plate 94 and the other leg of the pusher bar extending below and across the horizontal plate.

With such pusher bar secured to fingers 128, it is adapted to be placed astride the horizontal plate at one end to engage an inclined stack of partitions and move it to the other end of such plate. At such other end of the horizontal plate, the pusher bar is carried off the plate and down for return movement to engage another stack inclined against the inclined portion of the plate 96'. Here again, suitable means (not shown) effect operations to permit the inclined stack to move along the horizontal plate enough to clear the space into which the first partition of the next succeeding group appears.

I claim:

1. A high speed automatic stacker for collapsed partitions or the like comprising:

a vertical plate;

an inclined plate inclined at an obtuse angle with respect to the horizontal, the lower edge of said vertical plate being in a plane above the lower edge of said inclined plate;

a horizontal support between said vertical and inclined plates;

means to successively feed partitions in overlapping relation and in groups beneath said vertical plate and force the partitions of each group to gather into a stack against said inclined plate and supported on edge on said horizontal support;

means for removing each group thus stacked from between said vertical and inclined plates;

means synchronizing said feed means and removing means to cause said removing means automatically to move each group horizontally from between said vertical and inclined plates before the first partition of a succeeding group passes beneath said vertical plate;

and means operable in conjunction with said inclined plate for orienting each inclined stack to the vertical so the removed stacks are vertical.

2. An automatic stacker in accordance with claim 1, wherein said means for orienting the inclined stack to the vertical includes means pivotally supporting said inclined plate for movement to the vertical;

and actuator means engaging said inclined plate and operable to move it to the vertical and thereby move each inclined stack to the vertical;

and wherein the means to move the vertical stack horizontally includes a pusher element adapted to engage the stack;

and means for actuating said pusher element to engage and move the stack along said vertical plate, said actuator means being deactivated to permit said inclined plate to return from the vertical to inclined position following each actuation of said pusher element to move the stack along said vertical plate.

3. An automatic stacker in accordance with claim 1, wherein said orienting means includes a further plate extending from said inclined plate and which terminates in a vertical plate portion, said further plate having an intermediate plate portion between said inclined plate and vertical plate portion, the bottom edges of said inclined plate and said further plate being colinear, said intermediate plate portion forming a transition between the inclined plate and the vertical plate portion of said further plate, said vertical plate being coextensive with said inclined plate and said further plate;

and a pusher element included in said removing means and adapted to engage a stack at the end of the inclined plate, said synchronizing means operating said removing means so that said pusher element engages the stack and forces it along said further plate so as to right it to the vertical.

4. An automatic stacker in accordance with claim 3, wherein said means to feed the partitions towards and group them at the inclined plate includes conveyor means;

means above said conveyor means for successively receiving and dropping partitions singly and in overlapping relation onto said conveyor means;

a horizontal plate onto which to move said partitions from said conveyor means;

and pusher means movable along said conveyor means for engaging the last of a predetermined number of partitions dropped thereon and causing them to group at said inclined plate.

5. An automatic stacker in accordance with claim 4, wherein said conveyor means extends substantially to said inclined plate, whereby said partitions when grouped at said inclined plate are riding on said conveyor means, said pusher element being operable to move the inclined stack formed by the partitions grouped at said inclined plate off said conveyor means and onto said horizontal plate.

6. An automatic stacker in accordance with claim 4, wherein said means for successively receiving and dropping partitions singly and in overlapping relation onto said conveyor means is comprised of a pair of elongated finned rotors coupled for contra-rotation towards each other, and wherein said pusher means movable along said conveyor means includes spaced elongated pusher bars;

and spaced chains on opposite sides of said conveyor means and spaced apart a distance greater than the width of said conveyor means, each pusher bar being connected at its ends to said chains, said chains being endless loops passing above said rotors at right angles thereto and in a plane above and proximate to said conveyor means to permit said pusher bars to engage the last of respective groups of partitions dropped onto said conveyor means and push the partitions thereon beneath said vertical plate towards said inclined plate.

7. An automatic stacker in accordance with claim 4, wherein said horizontal plate extends the length of said inclined plate and said further plate, and wherein said pusher means movable along said conveyor means includes pusher fingers disposed along and carried by said conveyor means, said conveyor means being synchronized with said receiving and dropping means to permit respective pusher fingers to engage the last partition of a group and to force it and the partitions preceding it to gather against said inclined plate and form an inclined stack.

8. An automatic stacker in accordance with claim 6, said removing means including a linear actuator engaging said pusher element and adapted to move it along said horizontal plate from said inclined plate past said vertical plate portion.

9. An automatic stacker in accordance with claim 6, said removing means including spaced parallel chains below said horizontal plate, said pusher element extending between and being secured to said chains, said pusher element being U-shaped, one leg of which is secured at spaced points to the respective chains, the space between the legs being wider than the thickness of said horizontal plate, the legs of said pusher element straddling said horizontal plate during movement of said pusher element from the inclined plate end of said horizontal plate to the opposite end of said horizontal plate.

* * * * *